United States Patent [19]

Mulford

[11] Patent Number: 4,488,390

[45] Date of Patent: Dec. 18, 1984

[54] STRUCTURAL BUILDING MEMBERS AND WALL INCORPORATING SAME

[76] Inventor: Cass F. Mulford, R.D. 3, Canastota, N.Y. 13032

[21] Appl. No.: 371,905

[22] Filed: Apr. 26, 1982

[51] Int. Cl.[3] ..... E04B 2/14

[52] U.S. Cl. ..... 52/407; 52/220; 52/481; 52/729

[58] Field of Search ..... 52/729, 481, 404, 406, 52/407, 809, 690, 730, 480, 144; 49/DIG. 1

[56] References Cited

U.S. PATENT DOCUMENTS

| | | | |
|---|---|---|---|
| 1,377,891 | 5/1921 | Knight | 52/729 |
| 1,388,600 | 8/1921 | Posson | 52/481 |
| 2,191,804 | 2/1940 | O'Malley | 52/407 |
| 2,299,908 | 10/1942 | Leash | 52/407 |
| 2,649,135 | 8/1953 | Prase | 52/404 |
| 3,039,152 | 6/1962 | Hillesheim | 52/93 |
| 3,490,188 | 1/1970 | Troutner | 52/729 |
| 3,925,938 | 12/1975 | Molen | 52/729 |
| 4,068,434 | 1/1978 | Day | 52/404 |
| 4,195,462 | 4/1980 | Keller | 52/729 |
| 4,224,774 | 9/1980 | Petersen | 52/730 |
| 4,329,827 | 5/1982 | Thorn | 52/809 |
| 4,336,678 | 6/1982 | Peters | 52/729 |

FOREIGN PATENT DOCUMENTS

| | | | |
|---|---|---|---|
| 140019 | 4/1953 | Sweden | 52/729 |

*Primary Examiner*—John E. Murtagh

*Attorney, Agent, or Firm*—Charles S. McGuire

[57] ABSTRACT

An elongated structural member including two preferably identical wooden members permanently joined in spaced relation by a web member having a length equal to that of the wooden members and a thickness preferably not greater than about one-third that of the wooden members. A groove is formed centrally of one side of each of the wooden members along the full length thereof and marginal edge portions of the web, having a thickness substantially equal to the width of the grooves, are securely fastened in the grooves to join the wooden members. An additional member may be secured to the web along its length, with one edge in abutting relation to one of the wooden members and the other edge in spaced relation to the other wooden member to provide a channel for insertion of an edge portion of a panel member which extends between two of the structural members. When sheathing such as for inside and outside walls, is secured to the structural members, two separated spaces are defined on opposite sides of the panel member which may be used to house insulating material, electrical wiring and fixtures, plumbing, etc.

4 Claims, 5 Drawing Figures

STRUCTURAL BUILDING MEMBERS AND WALL INCORPORATING SAME

BACKGROUND OF THE INVENTION

The present invention relates to structural members for use in wood frame building construction, such as wall studs and composite wall structures wherein such structural members are employed. More specifically, the invention relates to an elongated member having a plurality of permanently joined elements which may be advantageously used as a wall stud, floor or ceiling joist, truss member, or the like.

In most frame-types building construction, the basic structural members have traditionally been elongated pieces of lumber cut to the necessary length and having nominal cross sectional dimensions such as 2"×4", 2"×6", etc. to provide the desired structural qualities; such members are used in walls as studs, floors and ceilings as joists and stringers, roofs as truss members, etc. They may be covered by sheets of plywood, plaster board, or other materials, to form the building enclosure and finished internally and externally as desired. The cost of the lumber, especially the more desireable types and grades, has risen to the point that alternate materials and construction methods have been devised. The standard cuts of lumber, however, remain by far the most widely used basic building elements in essentially all parts of the world.

It is a principal object of the present invention to provide a novel and improved structural element for building construction which utilizes and retains the advantages of the standard, elongated wooden members while improving many characteristics thereof.

A further object is to provide a structural member for use as a wall stud or other such building element, which utilizes standard cut lumber, yet provides better sound and thermal insulating qualities than a unitary wooden member.

Another object is to provide an elongated building member which may be provided in both larger and smaller sizes at a cost substantially directly proportionate to the amount of material involved, as opposed to conventional lumber which often increases in cost more than in proportion to an increase in, for example, length for the same cross section.

A still further object is to provide a wall stud member, and a wall system incorporating a plurality of such members, having superior insulating and structural qualities which permit the use of more economical construction methods while preserving the structural integrity of the wall.

Other objects will in part be obvious and will in part appear hereinafter.

SUMMARY OF THE INVENTION

The foregoing objects are realized according to the present invention by a basic structural element comprising, in its simplest form, a pair of elongated rectangular wooden members and a web member of lesser thickness having marginal edge portions affixed within grooves provided for such purpose in each of the wooden members. The web member may comprise any of a number of suitable materials, but is preferably of lower density and heat conductivity properties than the wooden members, such as a relatively low density pressed fiberboard of a type commercially available in sheets of standard lenths and widths. The web may be of slightly greater thickness than the width of the groove and the edge portions of the web force-fitted in the grooves, with or without a liquid adhesive, which may be utilized whether or not the web edges are force-fitted into the grooves.

The strength and rigidity of the structural member will, of course, be a function of the type and dimensions of the material used as the web member. These are selected to provide the structural qualities desired, which include the ability to support loads of the magnitude normally required in wood frame construction applied either to the ends (as to a wall stud or truss member) or to the sides (as to a joist or stringer). The members may be provided in extended lengths at considerable cost savings over single wooden members of comparable cross section and structural qualities, since splices of the wooden members and web may be effected at different points along the length of the member.

The invention further resides in a wall structure of superior heat and sound insulating qualities at reasonable cost which incorporates the aforementioned basic structural members with one or more additional members affixed to the web member to provide channels open at the sides of the structural members. With a plurality of the members vertically supported in spaced relation to form the wall studs, solid panels of proper size are placed with opposite marginal edge portions inserted in the channels of successive studs. The usual sheathing applied to both sides of the studs will thus define separate spaces on opposite sides of the panel member, which spaces may be conveniently utilized to contain other insulating materials, electrical and plumbing fixtures, etc.

DETAILED DESCRIPTION

Figure 1:
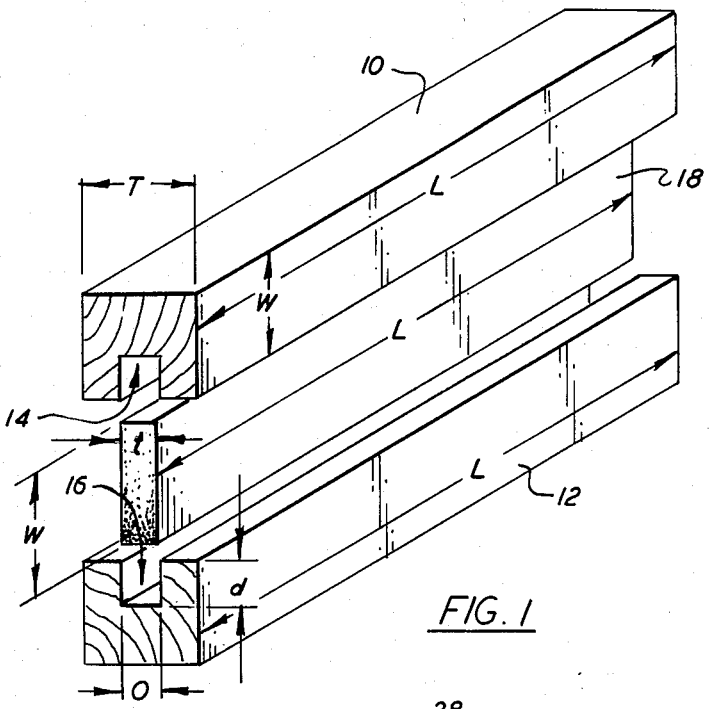
FIG. 1 is a perspective view of the elements of a basic structural member of the present invention prior to assembly.

Referring now to the drawings, in FIG. 1 are shown a pair of identical, elongated wooden members 10 and 12, each having a groove 14 and 16, respectively, centrally disposed in one face thereof along the entire length of the members. The length, width and thickness of members 10 and 12 are denoted by the letters L, W and T, respectively. Web member 18 has a length L equal to that of wooden members 10 and 12, a width w greater than the widths of the wooden members, and a thickness less than that of the wooden members, preferably not more than half ($\frac{1}{2}$T). Grooves 14 and 16, have a depth d, not more than one-half the width of member 10 and 12, and a width indicated by the letter O, being the width of the initially open side of the groove.

The structural member is assembled by inserting opposite marginal edge portions 20 and 22 of web member 18 into grooves 14 and 16 to the full depth thereof and permanently securing the members in this relation. Edge portions 20 and 22 may be secured in grooves 14 and 16 by making the width O of the grooves slightly less than thickness t of web member 18 and utilizing the slightly resilient nature of the wood and/or web to effect a force fit of sufficient strength to prevent subsequent separation of the members. Since the wooden members, and possibly the web member as well, are subject to dimensional changes due to differences in moisture content, etc., it is preferred that glue, epoxy, or other appropriate liquid sealant be applied to edge portions 20 and 22, and/or grooves 14 and 16 prior to insertion of the former into the latter. Insertion may be facilitated by tapering the entrance of the gooves as indicated at 24.

Figure 2:
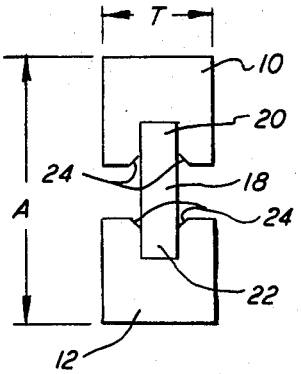
FIG. 2 is an end view of the elements of FIG. 1 after assembly.

The resulting structural member will, of course, have a length L and thickness T, equal to those dimensions of wooden members 10 and 12, and an overall width indicated in FIG. 2 by letter A. This may be varied as desired simply by making web member 18 of appropriate width, without changing wooden members 10 and 12. Structural qualities of the member such as load-bearing capacity, resistance to twisting or bending, etc. will be largely determined by the material and dimensions of web member 18. Although web member 18 may also be of wood, e.g. plywood, it is preferably, as previously mentioned, of a material having a different density and heat conductivity than wooden members 10 and 12. Many wood-composition products, of lesser density than the natural wood (normally a "soft" wood such as pine or fir, most commonly used in wood frame construction) of members 10 and 12, are suitable for use as the web material, including those commercially available under the trademarks, Homosote and Cel otex.

Figure 3:
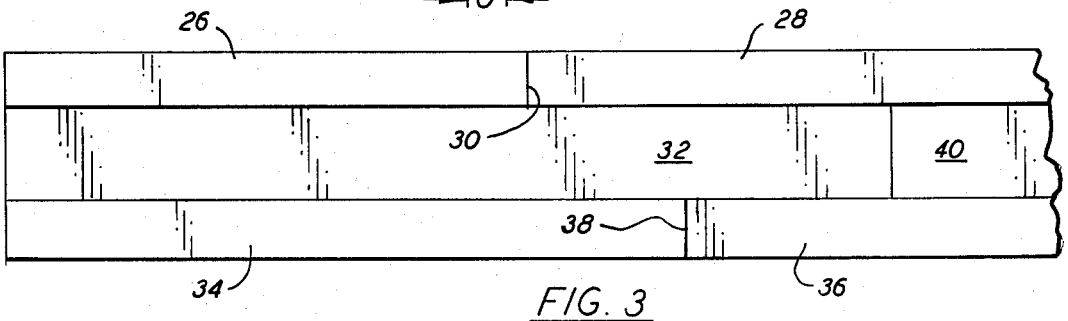
FIG. 3 is a side elevational view showing the preferred manner of splicing the elements of the structural members to provide extended lengths thereof.

One of the greatest economies which may be realized through the structural members of the invention is the ability to provide the members in virtually any length without improportionate cost increases. That is, the price of a 20 foot length of good quality lumber can typically be expected to be more than twice as much as two 10 foot lengths of the same cross section. Splicing the two 10 foot lengths by ordinary means would destroy the structural integrity of the member and in many cases render it unfit for the intended purpose. In FIG. 3 is illustrated the preferred means of providing the structural members of the present invention in the longer lengths. Wooden members 26 and 28 meet end-to-end at joint 30, both being connected to web member 32 which is secured in the grooves of members 26 and 28 as previously described. Wooden members 34 and 36 are likewise connected to web member 32 on the opposite side of the structural member from wooden members 26 and 28. Members 34 and 36 meet end-to-end at joint 38, which is spaced along the length of the structural member from joint 30. Web member 32 meets end-to-end with web member 40 at a point spaced along the length of the structural member from both joints 30 and 38, although it may lie between the two. Thus, a structural member of virtually any length can be provided, using a plurality of relatively short, cheap members, as opposed to a single member of the necessary length at far greater cost. The staggering of the joints provides continuous connection between the web members and the wooden members along each side, preserving the structural integrity of the composite member.

Figure 4:
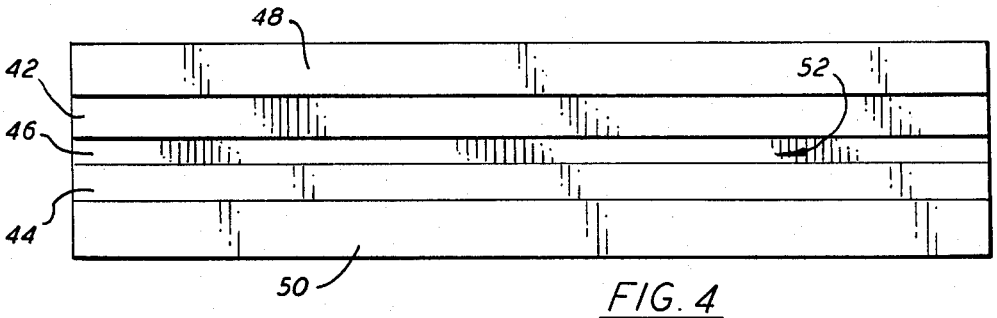
FIG. 4 is a side elevational view of another embodiment of the structural members.
Figure 5:
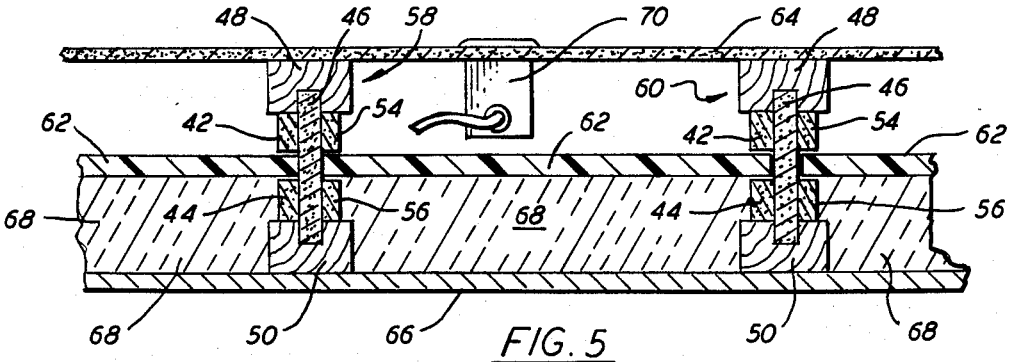
FIG. 5 is a plan view of a wall structure incorporating the structural members of FIG. 4.

Turning now to FIGS. 4 and 5, an alternate form of the structural member is shown which includes additional members 42 and 44 adhesively and/or mechanically secured in superposed relation to web member 46 on one side thereof. One edge of members 42 and 44 abut the facing surfaces of wooden members 48 and 50, respectively, and the other edges are spaced to provide an open channel 52 of desired width. Additional members 54 and 56 are likewise secured to the opposite surface of web member 46 in spaced relation to one another to provide a similar channel. As an alternative to the illustrated structural member, only a single additional element need be provided on each side of web member 46, having one edge in abutting relation to one of wooden members 48 and 50 with the open channel provided between the other edge of the additional member and the other wooden member.

A plurality of such structural members, as indicated generally in FIG. 5 by reference numerals 58 and 60, are arranged in vertically spaced relation to form the studs of a composite wall structure. Panel members 62, preferably unitary sheets of a material which is of light weight but good insulating qualities, e.g., Styrofoam, are placed with opposite edge portions in the facing channels 52 successive studs. The panel members extend the full height of the studs, but need not have more than minimal load-bearing capacity. Sheathing members 64 secured to wooden member 48 on one side of the row of studs, and sheathing members 66 secured to wooden members 50 on the other side thus serving to define two separated spaces on opposite sides of panel members 62 between successive studs.

One or both of the separated spaces may be filled with conventional insulating material 68. Leaving one space open, besides the insulating quality of the dead air space, provides a convenient area for mounting electrical boxes, such as that indicated at 70, for switches, receptacles, etc., as well as for the passage of electrical wires, plumbing pipes, etc. without the necessity of insulating around such elements. The composite wall structure utilizing the basic structural members of the invention is of excellent sound and heat insulating properties, thus being advantageously employed as either an interior or exterior wall. The fact that the studs are of initially separate, diverse materials, e.g., wood and fiber board, rather than being the usual single, continuous member between inside and outside sheathing, prevents direct conduction of heat and cold, as well as sound, directly through the members.

It should also be noted that the composite wall structure may be constructed with structural member such as those of FIGS. 1 and 2, if the channels between wooden members 10 and 12 are of proper width to accept the panel edges, without employing additional elements affixed to the web member.

A further significant advantage is the lower weight of the structural members than wooden members of the same overall outside dimensions, resulting in easier handling and lower shipping costs.

What is claimed is:

1. A building wall construction comprising, in combination:

(a) a plurality of elongated studs arranged in spaced, vertical, parallel relation;

(b) each of said studs comprising:

(i) first and second elongated rectangular wooden members, substantially identical to one another in length, width and thickness, each having a substantially rectangular groove in one face thereof, said grooves extending the entire length of said wooden members, centrally of the width, and having widths and depths a fraction of the width and thickness of said wooden members;

(ii) a web member of pressed fiber board having a density significantly less than and a length the same as said wooden members, a thickness substantially equal to the width of said grooves, and a width greater than the individual widths of said wooden members; and (iii) means securing opposite marginal edge portions of said web member in said grooves, substantially the full length thereof, thereby joining said wooden members in spaced relation, the dimensions and material of said web member being such that said structural member is suited for supporting loads applied at the ends;

(iv) said grooves having a depth not greater than one-half the depth of said wooden members and a width not greater then one-half the thickness of said wooden members;

(c) a pair of additional members secured to each side of each of said web members, said additional members being the same length as said studs and a depth less than one-half the distance between said wooden members and secured to said web members in spaced relation to form a channel of predetermined width open along one side and bounded on opposing sides by said additional members and on the bottom by said web members;

(d) a panel member having a height equal to the length of said studs, a width slightly less than the distance between said web members of consecutive studs in said wall, and a thickness less than said predetermined width, said panel member having edge portions extending into said channels of consecutive studs for support thereby and forming enclosed spaces between said sheathing members and each side of said panel member; and (e) sheathing members secured to opposite sides of said studs to enclose the latter and the spaces therebetween, whereby substantially all loads carried by said studs are in a longitudinal direction and said web member of each stud acts as both thermal and sound insulator between said wooden members and said sheathing members.

2. A building wall according to claim 1 wherein at least one of said enclosed spaces is filled by an insulating material.

3. A building wall according to claim 1 wherein one of said enclosed spaces is filled with an insulating material and the other of said spaces is open to provide space for mounting electrical fixtures and wiring, plumbing, and the like, between said sheathing member on one side of said studs and said panel member.

4. A building wall according to claim 1 wherein said panel comprises a sheet of expanded polystyrene.

* * * * *